US011655601B2

(12) United States Patent
Feghoul

(10) Patent No.: US 11,655,601 B2
(45) Date of Patent: May 23, 2023

(54) CONCRETE BLOCK, PARTICULARLY ACCESS-DENIAL BOLLARD, WITH ADDITIONAL FUNCTIONALITIES

(71) Applicant: Abdla Feghoul, Cestas (FR)

(72) Inventor: Abdla Feghoul, Cestas (FR)

( * ) Notice: Subject to any disclaimer, the term of this patent is extended or adjusted under 35 U.S.C. 154(b) by 905 days.

(21) Appl. No.: 16/481,219

(22) PCT Filed: Jan. 26, 2018

(86) PCT No.: PCT/EP2018/051979

§ 371 (c)(1),
(2) Date: Jul. 26, 2019

(87) PCT Pub. No.: WO2018/138276

PCT Pub. Date: Aug. 2, 2018

(65) Prior Publication Data

US 2019/0382970 A1 Dec. 19, 2019

(30) Foreign Application Priority Data

Jan. 26, 2017 (FR) ..... 1770085

(51) Int. Cl.

| | |
|---|---|
| ***E01F 13/02*** | (2006.01) |
| ***E01F 9/692*** | (2016.01) |
| ***E01F 13/12*** | (2006.01) |

(52) U.S. Cl.

CPC ..... *E01F 13/028* (2013.01); *E01F 9/692* (2016.02); *E01F 13/12* (2013.01)

(58) Field of Classification Search

CPC ..... E01F 9/962; E01F 13/028; E01F 13/12; E01F 9/692

(Continued)

(56) References Cited

U.S. PATENT DOCUMENTS 802,143 A * 10/1905 Haffey ..... E04H 17/00 52/40
811,022 A * 1/1906 Young ..... E04H 17/00 256/13.1

(Continued)

FOREIGN PATENT DOCUMENTS

| | | |
|---|---|---|
| DE | 90 04 489 | 6/1990 |
| EP | 2 230 356 | 9/2010 |

(Continued)

OTHER PUBLICATIONS

International Search Report, PCT/EP2018/051979, dated May 16, 2018.

*Primary Examiner* — Raymond W Addie
(74) *Attorney, Agent, or Firm* — Nixon & Vanderhye

(57) ABSTRACT

Disclosed is a concrete block, preferably made of fiber-reinforced concrete, including a body and anchor intended for lifting the block. The anchor is secured to the body and arranged in blind cavities without protruding out of these cavities, particularly arranged at the level of one of the faces of the body of the block such as the upper face of the block when the block is in the installed position on the ground. The body includes reservations and/or attachment/association components, the reservations and the attachment/association component being intended for attaching, preferably removably, or associating, technical equipment that is to be associated with the block. The concrete block is intended to constitute an access-denial bollard and, as a secondary function, a block for supporting and to which to fix technical equipment.

20 Claims, 8 Drawing Sheets

(58) Field of Classification Search
USPC ..... 404/6–11
See application file for complete search history.

(56) References Cited

U.S. PATENT DOCUMENTS 838,592 A * 12/1906 Smith ..... 52/157
841,163 A * 1/1907 Livengood ..... E04H 17/08 52/146
869,137 A * 10/1907 Down ..... 52/146
883,022 A * 3/1908 Hornshaw ..... 256/13.1
883,491 A * 3/1908 Scott ..... E04H 17/00 256/49
887,498 A * 5/1908 McElinney ..... 256/13.1
904,487 A * 11/1908 Kessler ..... 52/157
910,950 A * 1/1909 Noll ..... 256/13.1
930,040 A * 8/1909 Carpenter ..... E01F 9/0165 404/6
931,396 A * 8/1909 Toennes ..... 256/13.1
940,996 A * 11/1909 Wessels ..... 52/157
943,648 A * 12/1909 Bryant ..... 256/13.1
980,955 A * 1/1911 Huber ..... E04H 17/00 256/13.1
982,957 A * 1/1911 Haddon ..... 256/13.1
1,050,389 A * 1/1913 Pitluck et al. ..... E04H 17/10 256/50
1,087,498 A * 2/1914 Kirkwood ..... E04H 17/10 256/50
1,104,626 A * 7/1914 Chambers ..... E04H 17/10 256/49
1,119,711 A * 12/1914 McGee ..... E04G 13/02 249/169
1,147,075 A * 7/1915 Burris ..... E04G 13/02 249/165
1,174,749 A * 3/1916 Martins ..... E04H 17/06 256/51
1,185,665 A * 6/1916 Hellstrom ..... E04H 17/06 256/51
1,204,187 A * 11/1916 Pickrell ..... E04H 17/10 256/49
1,235,830 A * 8/1917 Miller ..... E04H 17/10 256/52
1,628,645 A * 5/1927 Andrews ..... E04H 17/08 52/146
2,574,711 A * 11/1951 Rose ..... E04H 17/20 52/439
2,578,165 A * 12/1951 Bailey ..... E04H 17/06 249/143
3,045,977 A * 7/1962 Haile ..... E04H 17/20 256/70
4,142,711 A * 3/1979 Brimhall ..... E04H 17/00 256/13.1
5,156,485 A * 10/1992 Ivey ..... E01F 15/088 404/6
5,551,662 A * 9/1996 Keady ..... E04G 21/1841 249/48
5,752,691 A 5/1998 Bashon et al.
6,382,869 B1 5/2002 Dickinson
7,144,187 B1 * 12/2006 Nolte ..... E01F 15/088 404/6
8,994,559 B1 * 3/2015 LaRocco ..... E01F 9/0165 404/6
2003/0086761 A1 * 5/2003 Anderson ..... E01F 13/022 404/6
2004/0004211 A1 * 1/2004 McEnroe, Jr. ..... E04G 21/185 256/65.04
2009/0313912 A1 * 12/2009 Perry ..... E04H 12/12 52/40
2016/0060830 A1 * 3/2016 Muegerl ..... E01F 13/00 404/6

FOREIGN PATENT DOCUMENTS

GB 2224048 * 9/1988 ..... E04H 17/14
GB 2 493 199 1/2013
WO WO 88/08057 10/1988

* cited by examiner

CONCRETE BLOCK, PARTICULARLY ACCESS-DENIAL BOLLARD, WITH ADDITIONAL FUNCTIONALITIES

BACKGROUND OF THE INVENTION

Field of the Invention

The invention relates to a concrete block, particularly used as a protective and anti-intrusion/access-denial device, and/or support base for functional or signposting elements, to be set up in particular temporarily on a public road or at sites of events.

The concrete block of the invention is not particularly intended for construction.

The invention will be more particularly described, without, however, being limited thereto, in regard to a use for public protection as protective and access-denial devices to be set up on the periphery of sites that are likely to receive a large number of people, such as during temporary events, to stop all vehicles attempting to get into the sites. Advantageously, the device of the invention is intended to be associated with other technical functions, such as for support and temporary arrangement of functional elements, reliably and securely, at crossings, stopping points. Without being exhaustive, the concrete block of the invention is intended to be used to support poles, posts, gateways, barriers, fences, construction fencing, electric power distribution cabinets.

Description of the Related Art

Today, protection of events or denial of entry into sites is done by arranging barriers and/or concrete blocks placed at strategic locations where there is a risk of vehicles passing through. However, the barriers do not constitute effective protective systems because they cannot withstand a vehicle passing through.

As for the concrete blocks of known type on public roads, although protective, they are either time-consuming to set up, in particular to be arranged temporarily at a location, because they are not equipped with any grip to offload them, to set them up, and pick them up again, or they can be moved too easily because they are in particular provided with an undercut base configured for the passage of the prongs of a forklift.

Certain blocks are nevertheless equipped with reinforcements forming arches that project from their upper surface to be hooked and lifted. However, these projecting arches are not completely secure and remain hand-made without any determination of mechanical strength, particularly for people passing by when these blocks are placed at crossing points.

SUMMARY OF THE INVENTION

The invention therefore has as its object to propose a concrete block, in particular with an access-denial function, which does not have the above-mentioned drawbacks, while avoiding any risk of movement that is too easy by current machines, allowing an easy placement and lifting as a result of lifting machines that are adapted and provided with non-standard hooking means, and also providing other functions such as those of base or of support for a technical apparatus that is in particular to be set up temporarily, reliably and securely.

By access-denial block is meant a block that has a substantial mass to be put in place and removed only by lifting machines; such a block can have in particular a mass on the order of at least 500 kg.

According to the invention, the concrete block has a body, preferably with a general parallelepiped shape, and anchoring means intended for the lifting of the block, and is characterized in that the anchoring means are integral with the body and mounted in blind cavities without protruding out of these cavities, in particular mounted in the area of one of the faces of the body of the block such as the upper face of the block when the block is in the set-up position on the ground, and in that the body has spaces (recesses) and/or attachment or engagement means, said spaces and the attachment/engagement means being intended for the attachment, preferably a releasable attachment, or the engagement, of technical apparatus to be engaged with the block.

"Without protruding out of these cavities" means the fact that the anchoring means extend from the bottom of the cavity while being at most coplanar with the plane of the outer face of the body comprising the cavities.

In the following description, the terms "horizontal," "vertical," "upper," "lower," "high," "low," "height" are used in the context of a normal set-up of the block, i.e., relative to a vertical sense in relation to a horizontal flat ground on which the block would be placed.

Preferably, the concrete block is a block with an access-denial function.

Thus, the concrete block of the invention has different functionalities added to its access-denial function. The block is manufactured and delivered ready to be set up and used, the specific spaces and/or attachment means making it possible to insert and mount technical apparatus on the block, directly on site.

Advantageously, the concrete block is fiber-reinforced, having reinforcement fibers in it.

According to a characteristic, the anchoring means are configured to work with special lifting engagement means, the anchoring means being able to work mutually only with a single type of lifting means that are specifically dedicated to the type of anchoring means, so that the anchoring means cannot work with a universal lifting/hooking system or a very common lifting system of the very common hook type. Thus, only specific, non-standard, lifting/anchoring means can lift the concrete block of the invention. Even if the blocks are on public roads, it is impossible to move them without calling for specialist third parties that have available lifting cranes equipped with specific lifting hooks/tools for working with the anchoring means of the block. By way of example, the anchoring means are in the shape of spheres or mushrooms, of the type of those marketed by the ARTEON Company.

According to another characteristic, the body of the block has edges that are beveled, in particular the body having a general parallelepiped shape and at least its edges referred to as vertical in the set-up position of the block and those of the upper face and optionally the edges of any surface recess being beveled.

According to yet another characteristic, the body of the concrete block has at least two opposite faces referred to as lower and upper, and a peripheral wall referred to as a lateral wall connecting the two opposite faces, the outer surface of the lateral wall having, preferably over its entire periphery and preferably in its middle part, a space forming a recess of the outer surface (toward the interior of the body) to make a throat, said throat being in particular intended to be used as an attachment surface.

According to another characteristic, the body, which has at least two opposite faces referred to as lower face and upper face, and a peripheral wall referred to as a lateral wall connecting the two opposite faces, is such that the outer surface of the lateral wall comprises at least one attachment plate as attachment means, the attachment plate being equipped with one or more attachment/engagement elements that are intended to work with at least one apparatus to be engaged with the block so as to engage at least one barrier, in particular a bar barrier of the police type or referred to as a Vauban barrier, in particular the attachment element being a bar or an element able to work by mutual engagement with the apparatus to be engaged, or the engagement element being at least a pair of guide rollers between which a barrier is intended to slide.

In one embodiment, the attachment element is telescopic; it is adjustable in length in a horizontal plane when the plate is attached to the block so as to make possible an adjustment of the distance that separates the block from the technical apparatus to be engaged. In particular, the attachment element has a hook that is integral with a slider that is able to be mobile in a tube by way of an adjusting screw that works with the slider whose adjusting head projects out of the tube opposite the hook.

Preferably, the body of the concrete block has a parallelepiped shape and the attachment plate or plates are at right angles and are secured against an angle of the parallelepiped body.

Advantageously, the body that has at least two opposite faces referred to as lower and upper and a peripheral wall referred to as a lateral wall connecting the two opposite faces constitutes a base/a foundation for the attachment on its upper face and/or its lateral wall of at least one technical apparatus, preferably its lower face being flat continuously from or in the proximity of one edge up to the edge or near the opposite edge. This surface continuity in the area of the lower face makes it possible not only to ensure stability to the block but especially furnishes security without the possibility of lifting from underneath using means of the forklift type.

The body can have, in particular on the face equipped with anchoring means, as a space, a central opening, said opening being intended to receive a pole or a post, and/or as attachment means, an attachment interface plate, and/or attachment elements of the threaded-rods type, particularly the plate or the attachment elements being intended for the attachment of at least one support leg or of a post, such as a signpost, or a lamp, or a post for an advertising panel, or a post for a gateway, preferably the post being equipped with means for adjustment in height for the apparatus working with said post.

The concrete block can constitute a base/a foundation for the attachment on its upper face of an electric power distribution cabinet, or of at least one support leg for the attachment to the support leg of an apparatus, such as a fence, fencing.

The concrete block can have hinged and foldable panels, at least one of which is attached to a lateral wall of the block, preferably the panels, in the folded position, being stored around the block, which reduces the bulk of the functional concrete block with its panels. The panels can, for example, constitute a fence in the unfolded state.

Advantageously, the concrete block has at least one illuminating system, particularly a reflector, in particular positioned in the lower part of the block in the set-up position of the block and able to illuminate upward, preferably able to illuminate with an illumination angle that corresponds to the two upper angles (corners) (of the upper end) of the block to identify the size of the block at night.

In an additional embodiment, the concrete block has at least one space in which a traffic barrier is intended to be attached, preferably a collapsible traffic barrier that is stored in the collapsed state in said space.

In yet another additional embodiment, the concrete block has, on the one hand, a first space that passes through the entirety of the body of the block, in particular along the entire height of the block, and that is intended to house a bar with a length that is less than that of the space, and, on the other hand, a second space constituting an access passage to the first space, the bar being intended to work with a connecting element intended to be inserted into the area of the first space by way of the second space.

The invention also relates to the use of at least one concrete block of the invention as an access-denial block that combines at least one other function by furnishing a base and/or a support for attachment/engagement of at least one technical apparatus such as a pole, a post, a gateway, a support leg, an electric power distribution cabinet, a signpost, a hooking bar, a barrier, fencing, a fence, an access-denial traffic barrier, and particularly use of several concrete blocks of the invention connected by connecting elements that are integrally engaged with the blocks so as to arrange a string of concrete blocks that are spaced apart and connected integrally to one another, or else use of at least two concrete blocks that are spaced apart and connected to one another by at least one traffic barrier attached to the blocks and able to be unfolded.

BRIEF DESCRIPTION OF THE DRAWINGS

This invention is now described using examples that are uniquely illustrative and in no way limiting of the scope of the invention, and from the attached illustrations, in which.

DESCRIPTION OF THE PREFERRED EMBODIMENTS

The concrete block 1 of the invention illustrated in the figures is a solid concrete block, of substantial mass, in particular on the order of 500 kg to beyond a ton, intended primarily to constitute an access-denial block for vehicles.

The concrete block is preferably made of fiber-reinforced concrete.

According to the invention, the block 1 is provided with other technical functions, and in particular is intended to constitute a base or a support for attachment of various technical apparatus, particularly for technical apparatus that is intended to remain temporarily at a location. FIGS. 6A to 18C illustrate in a non-exhaustive manner different examples of use of the concrete block of the invention with various technical apparatus.

Figure 1:
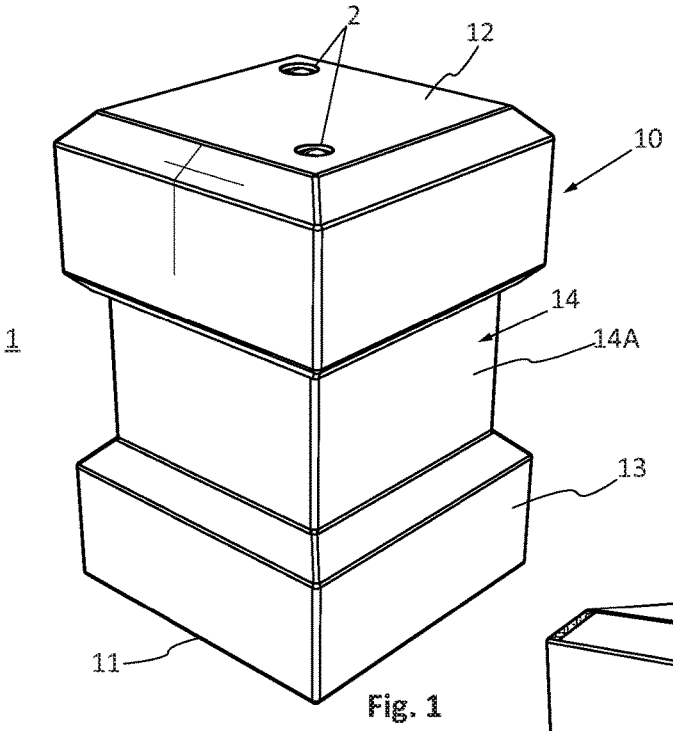
FIG. 1 represents a perspective view of an embodiment of the concrete block according to the invention.
Figure 2:
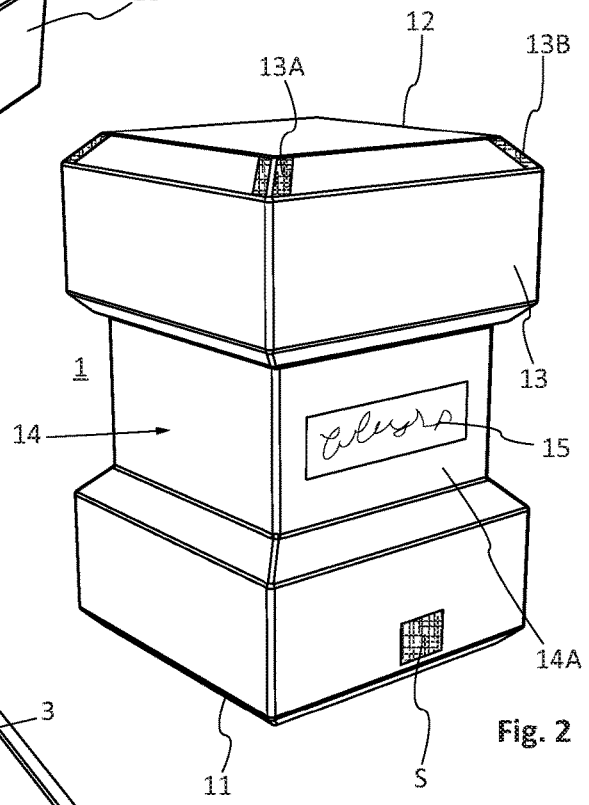
FIG. 2 is a variant embodiment of FIG. 1.

With regard to FIGS. 1 and 2, the concrete block 1 has a body 10 that is cylindrical and comprising a lower face 11, an upper opposite face 12, and a vertical peripheral lateral wall 13 connecting the two faces 11 and 12. The base of the cylindrical body is preferably polygonal but could be round, oval . . . . According to a preferred example, the body has a parallelepiped shape with a square or rectangular base, the peripheral wall 13 comprising four vertical faces.

Preferably, the body 10 of the block has—on its lateral wall 13 surrounding it and in its middle part—a space 14 forming a peripheral throat. This peripheral throat 14 comprises a back 14A that is therefore located in a plane that is parallel and offset in relation to the outer plane of the lateral wall 13.

The space 14 can be used, for example, as a support for a signpost, such as a plaque 15, the plaque being able in particular to be covered by a film having a microprism array and having very strong retro reflectivity. The space 14 is advantageously at, or approximately at, the corresponding height of a vehicle license plate. Thus, the blocks 1 of the invention are easily identifiable at night by the illumination of the passing motor vehicles.

Advantageously, the lower face 11 is completely flat, so that in the set-up position on the ground, it is impossible to lift the block from its base.

As is seen in the embodiment illustrated, the block is parallelepiped-shaped with a square base and is symmetrical relative to the median horizontal plane.

Preferably, the edges of the body 10, delimiting the lower face 10 and the upper face 11, the vertical faces of the lateral wall 13, and the throat 14 are beveled (with sloped sides) and/or are rounded, so as to avoid sharp edges that otherwise would risk injury, especially since the block can have a height that is almost the height of a man.

Preferably, the dimensions of the block 1 are provided to be able to maximize their number in a 10-ton transport truck.

By way of example that is in no way limiting, the dimensions of a block 1 of the invention that is parallelepiped with a square or rectangular base are the following:

Height: 900 or 950 mm,

Width and length: 900 or 950 mm×900 mm or 950 mm for a square base, and 600 mm×900 mm for a rectangular base, Height of the throat 14: 200 or 210 mm, Depth of the throat (dimension in a horizontal plane): on the order of 50 mm.

Figure 3:
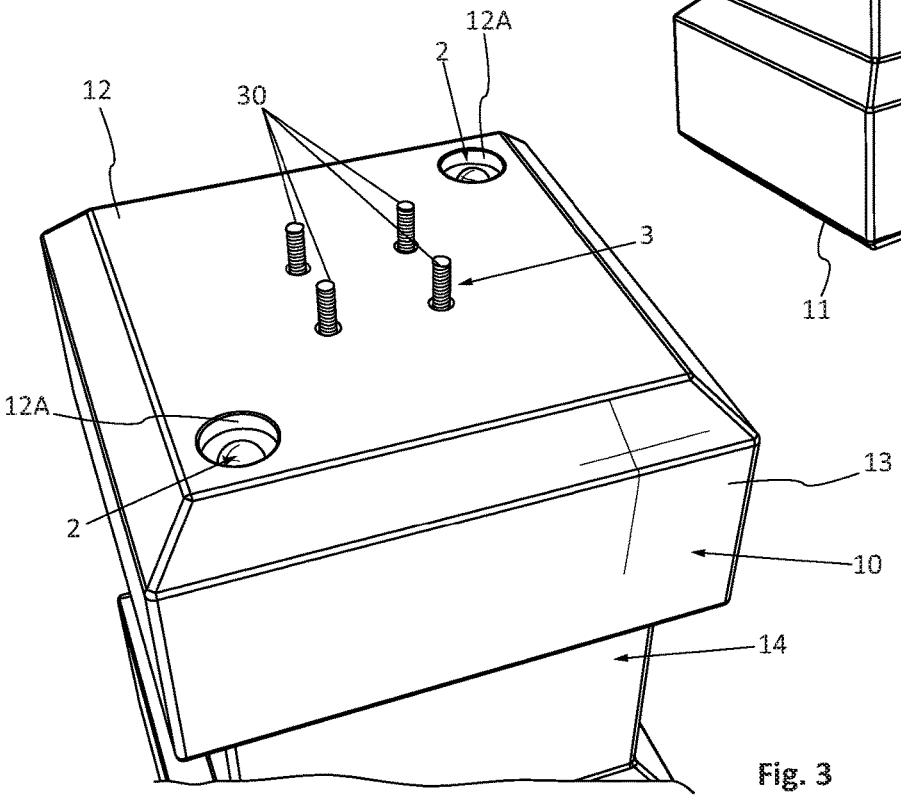
FIG. 3 is a view in partial perspective and from above of the block of the invention equipped with attachment means intended for the attachment of at least one technical apparatus.
Figure 4:
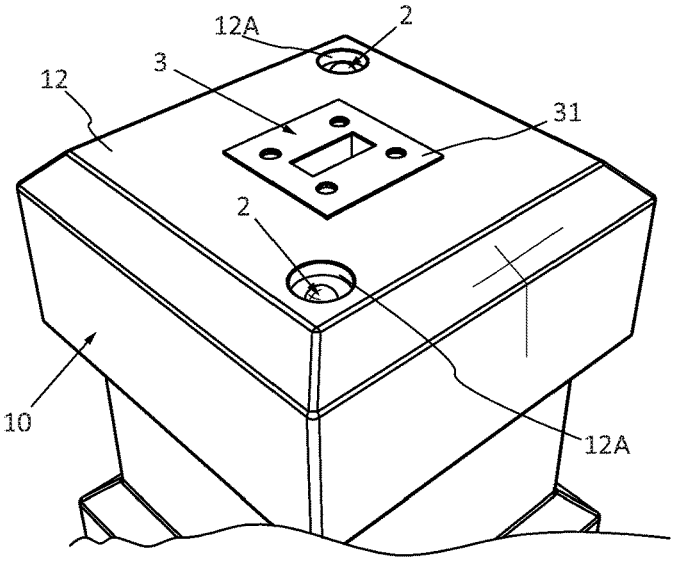
FIGS. 4 and 5A are views in partial perspective and from above of a variant embodiment of the block.

With regard to FIGS. 3 and 4, the block 1 has, according to the invention, anchoring means 2 that are integral with the body 10 and that are intended for the lifting of the block, attachment means 3 that are integral with the block, and/or at least one space 14 and/or 4 and/or 5 and/or 6 and/or 7 (FIGS. 1, 5A, 6, and 18A), the attachment means 3 and the space or spaces 14, 4, 5, 6 and 7 being intended to work with at least one apparatus to be mounted on/against the block, or to be engaged in the immediate proximity of the block.

The anchoring means 2 are advantageously arranged on the upper face 12 of the body in blind cavities 12A. Preferably, there are two, and they are arranged symmetrically opposite, here along a diagonal.

According to the invention, the anchoring means 2 do not go beyond the plane made by the upper face 12. They are therefore incorporated into the body 10 without protruding.

Preferably, the anchoring means 2 are configured to not be able to work with standard lifting means, but to work with specific non-standard lifting means, such as anchoring systems of the type of those marketed by the ARTEON Company. Thus, the anchoring means preferably do not have a ring shape or bridge design. They have, for example, a general geometry of a spherical or mushroom shape.

Depending on the use of the block, the attachment means 3 are arranged on the upper face 12 and/or on the peripheral wall 13.

The attachment means 3 are, by way of example, threaded rods 30 (FIG. 3), here numbering four, whose spacings correspond to standard attachment plates for the feet of posts.

In the variant embodiment of FIG. 4, the attachment means 3 are an attachment interface plate 31, this plate being adapted as a function of the type of apparatus to be received and to be attached there. The plate is preferably made of galvanized steel.

Figure 5A:
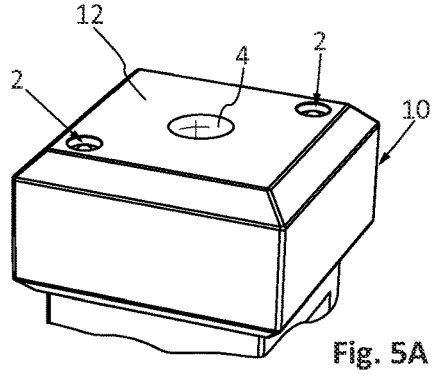
Figure 5B:
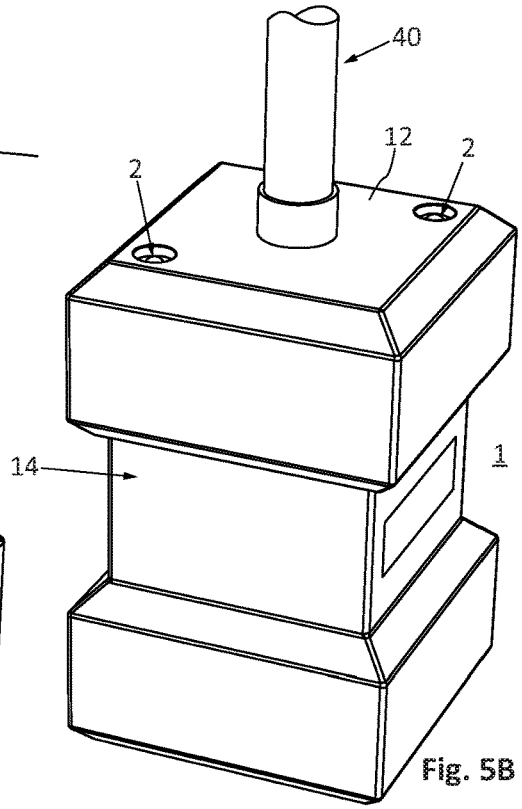
FIG. 5B is an example of use of the block of FIG. 5A equipped with a pole.

The space 4 illustrated by way of example in FIG. 5A forms a central opening in the body of the block in the area of the upper face 12, which makes it possible to accommodate there a pole 40 as illustrated in FIG. 5B.

Figure 6:
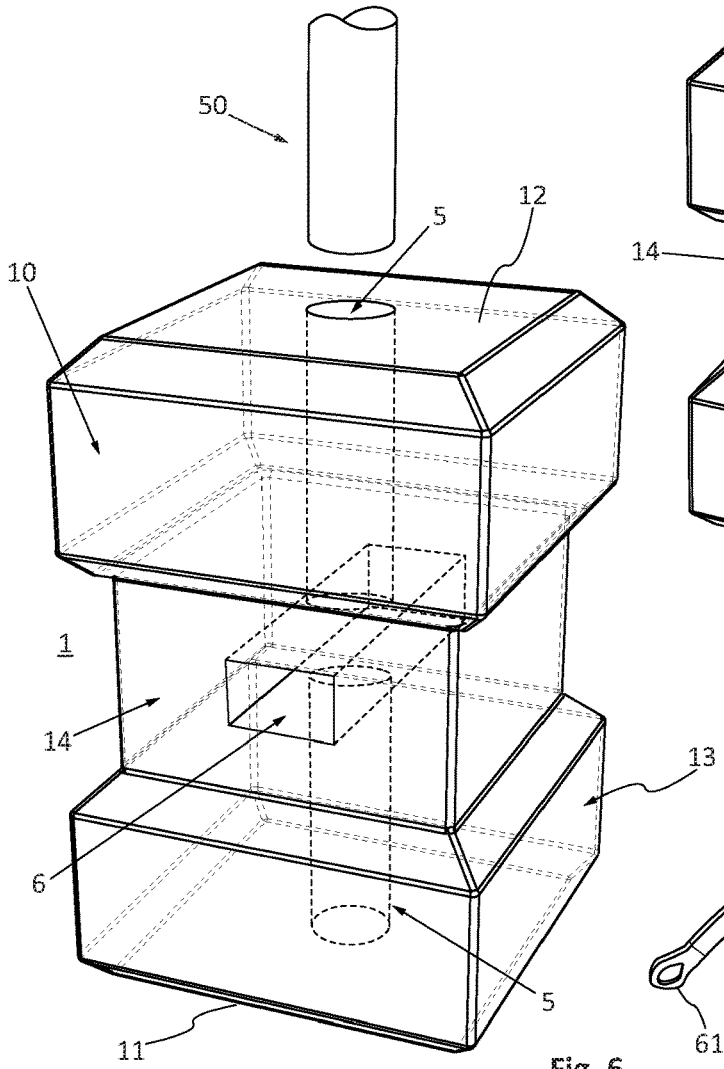
FIG. 6 is a perspective view of the block of the invention according to another variant embodiment and intended for the attachment of a connecting element.
Figure 6:
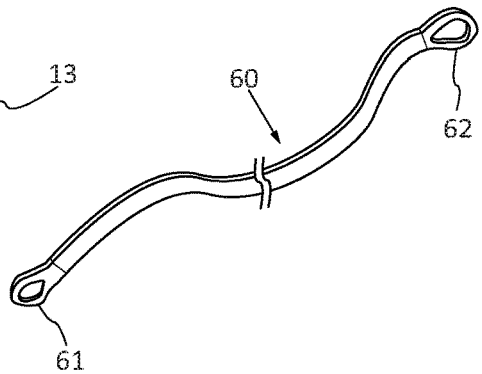

FIG. 6 illustrates another variant embodiment of the concrete block 1, whose details will be described below. The block of this variant has the space 14 that constitutes the peripheral throat, a space 5 forming an oblong bore with a longitudinal axis along the height of the block, and a space 6 hereafter referred to as a cross space. This space is provided in the lateral wall on at least one of the vertical faces and preferably in the lower part of the block or in the middle part.

Figure 18A:
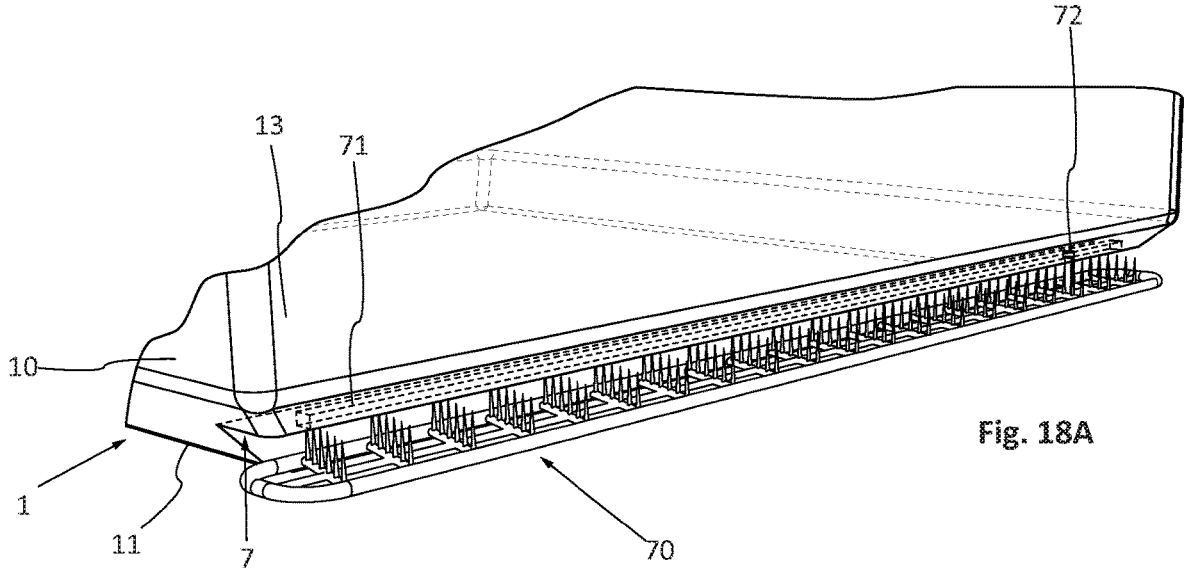
FIG. 18A is a partial perspective view of an example embodiment of the block of the invention with which a traffic barrier is engaged.

Other locations of spaces can be envisaged as a function of the use of the concrete block and of the functional apparatus to be engaged with it. FIG. 18A shows still another example embodiment for which the concrete block 1 has two spaces in the lower part, of which a single space 7 is visible. This variant embodiment with regard to its use will be described below.

The spaces 14, 4, 5, 6 and 7 are made during manufacturing by molding of the blocks. Preferably, all of the blocks systematically have the peripheral throat 14. The other spaces such as the central opening 4, the bore 5, or the cross spaces 6 and lower spaces 7 are produced (during the molding of the block) as a function of the destination/the final use of the block of the invention.

Preferably, the concrete block 1 has—with regard to FIG. 2—an illumination system S, particularly a reflector, which is in particular positioned in the lower part of the block and is able to illuminate upward so as to illuminate with a corresponding illumination angle at two upper corners 13A and 13B of the block to identify the size of the block at night.

Different examples of embodiment and use, in no way limiting, are now described with regard to FIGS. 6 to 18C.

Again with regard to FIG. 6, the latter illustrates a concrete block 1 of the invention used to attach thereto a connecting element 60 intended to connect remotely two concrete blocks 1. Preferably, a security device could have a string of concrete blocks of the invention, connected to one another by connecting elements. This connecting element 60 is preferably flexible and mechanically solid, such as a strap, a cable. The connecting element is intended to be stretched between two concrete blocks 1 to push aside a truck that would run into said element and the blocks, forcing the truck that is striking a block to deviate from its path and finally to be stopped by the string of blocks. Preferably, the concrete blocks 1 would be spaced apart by about 1,400 mm, the connecting element 60 having a corresponding length of separation.

The connecting element 60 is made integral with a concrete block 1 so as to be able to be disengaged from the block only during the lifting of the block at the time of moving, removing the block from the place where it has been placed with regard to its access-denial function.

For this purpose, the body 10 of the block 1 has at least one vertical space 5 that extends along the entire height of the block and at a distance from the peripheral wall 13, a locking bar 50 that is intended to be inserted and to slide into the space 5 as well as to work with the connecting element 60 to be added, and at least one access cross passage 6 (cross space) extending from the peripheral wall 13 to the vertical space 5.

The vertical space 5 forms an oblong bore with a longitudinal axis along the height of the block and is passing through along the entire height of the block while leading to the two opposite faces: lower face 11 and upper face 12. The cross-section of the bore is measurably greater than that of the locking bar 50 so that the latter can slide. By way of example, the cross-section of the space is 40 mm while that of the bar is 34 mm.

The locking bar 50 is rigid, preferably metal. It has a length that is less than the height of the concrete block 1. Thus, in the position that is totally inserted into the vertical space 5, it cannot protrude out from the upper face 12, making it inaccessible. By way of example, for a concrete block body 950 mm high, the locking bar has a length of 750 mm.

The access passage 6 makes it possible to insert the connecting element 60 into the area of the vertical space 5 to then engage the locking bar 50 there. The passage is limited in volume to optimize the weight of the block. Preferably, it has a cross-section along a vertical plane that is customized to the engagement of a hand and of the end of the connecting element. By way of example, the passage has a cross-section of 150 mm by 150 mm.

The connecting element 60 has at its two opposite free ends 61 and 62 a closed loop that is non-detachable from the rest of the connecting element.

The engagement of a connecting element on a concrete block 1 of the invention is as follows: the block is put into place on the ground. One of the free ends 61 of the connecting element 60 is inserted into the passage 6 up to the vertical space 5, the loop 61 being aligned relative to the vertical axis of the space. Then, the locking bar 50 is inserted into the vertical space 5 from the upper face 12 of the block, causing it to slide through the loop 61 of the connecting element, to the bottom of the block 1, with the bar abutting against the ground. Thus, the connecting element 60 is engaged in this block 1, without being able to be removed.

To disengage the connecting element 60 from the block and to withdraw it, it is necessary to lift the concrete block 1, by at least the height of the bar 50, to cause said locking bar to fall from the lower face 11 of the block. The loop 61 of the connecting element is then freed from the bar; by pulling back on the connecting element 60 from the passage 6, the connecting element is withdrawn from the block.

Figure 7A:
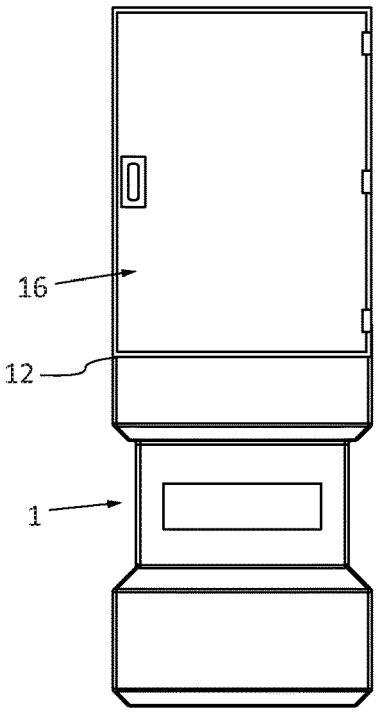
FIGS. 7A and 7B illustrate another example of use of the block as a support foundation for an electric power distribution cabinet, respectively with the door of the cabinet closed and open.
Figure 7B:
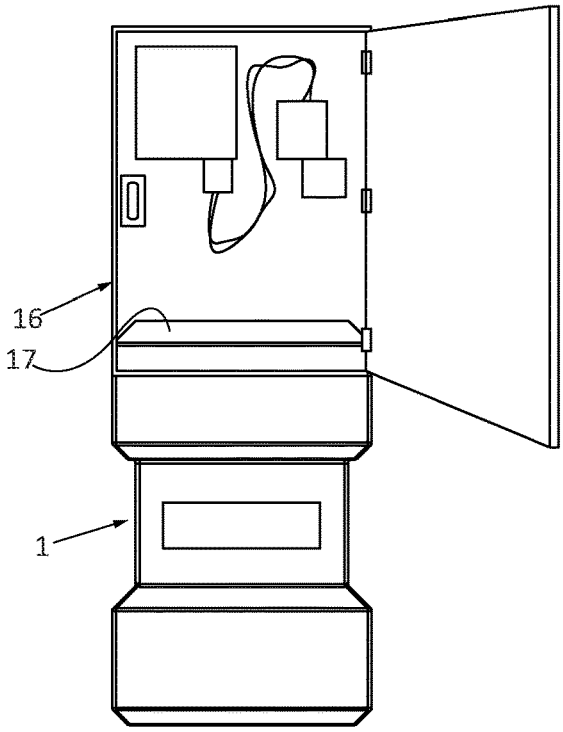

FIGS. 7A and 7B illustrate the block 1 that is used as an attachment and support base for an electric power cabinet 16. It is common during temporary events to have to install electric power distribution cabinets. The concrete block of the invention makes it possible to install the cabinet at a height and not on the ground as is customary, the concrete base making possible a solid seating, without risk of tipping over the cabinet, for example in the event of inadvertent striking by a vehicle, in the event of wind or of crowd movement, and facilitating access to the cabinet at a man's height.

The electric power cabinet 16 is attached to the upper face 12 of the body of the block, for example by attaching in a releasable manner its bottom 17 to the attachment means 3 of the block (not visible here) that are adapted accordingly.

Figure 8:
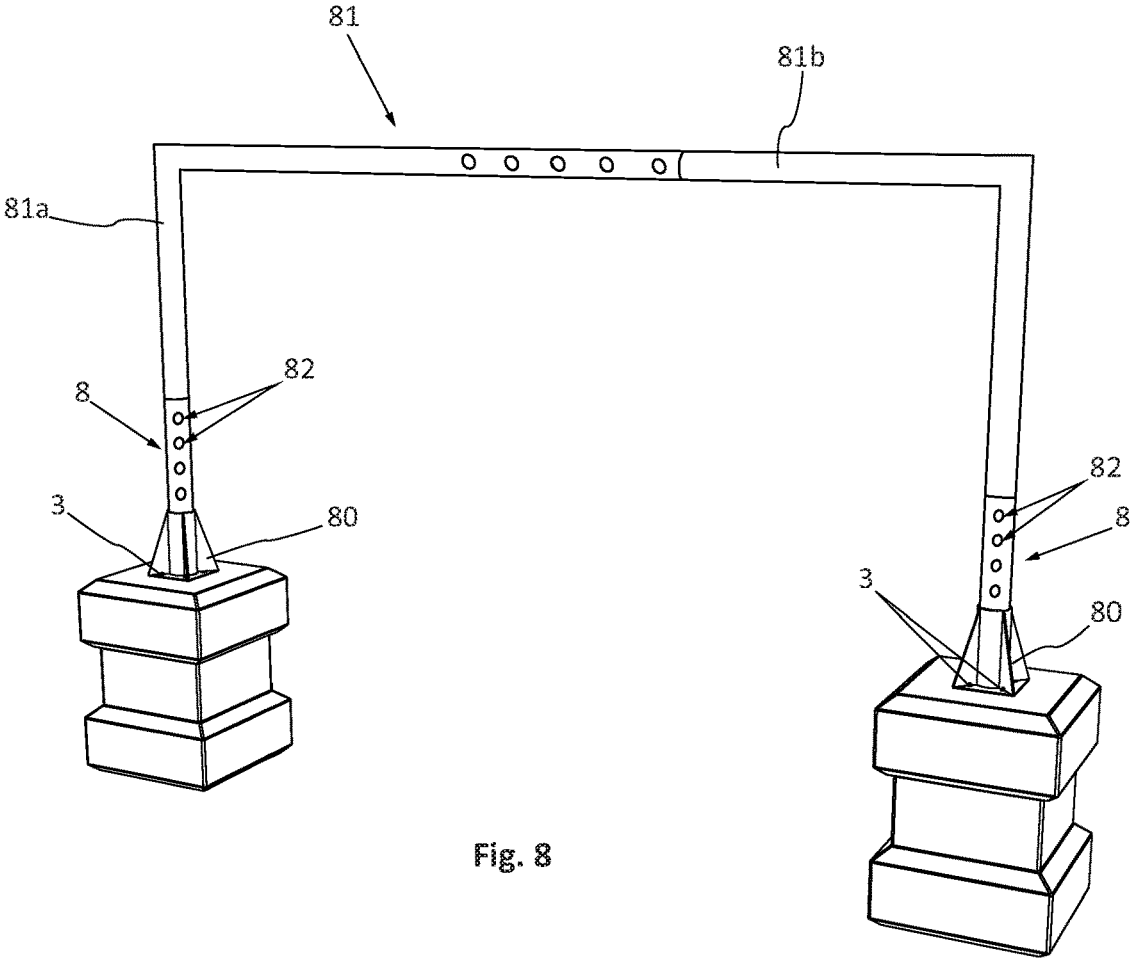
FIG. 8 shows the use of two blocks of the invention as supports of a gateway.

FIG. 8 illustrates two concrete blocks 1 of the invention, spaced apart. Each supports a post 8 that is integral with an attachment plate 80 that is attached to the upper face 12 of the block by means of the attachment means 3. Each of the posts 8 makes possible the attaching of a gateway 81, generally made of two parts 81A and 81B, to adjust the length of the gateway. Advantageously, the posts 8 have means 82 for adjusting the height of the gateway.

Figure 9:
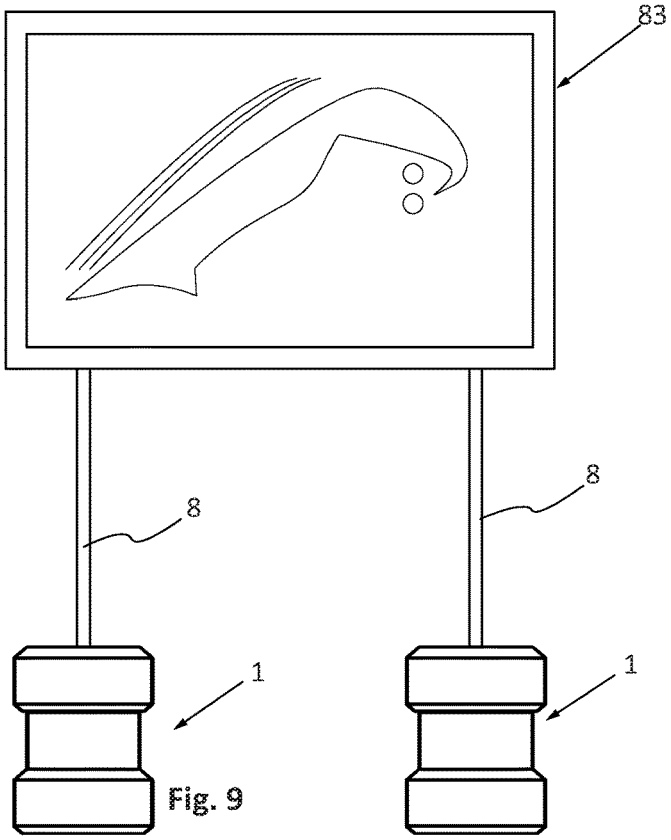
FIGS. 9 to 12 illustrate other examples of use of the block of the invention as support for technical apparatus, respectively, support for an elevated panel, support for a banner, for a signboard, and for an advertising apparatus.

FIG. 9 shows another example of use of the concrete block 1 of the invention, making it possible to support in height a display panel 83, in particular to be set up temporarily at a location. The panel 83 is arranged by placing, spaced apart, two concrete blocks 1 of the invention constituting, in addition to the access-denial blocks, ballast blocks, and each supporting a post 8 to which the panel 83 is attached.

Figure 10:
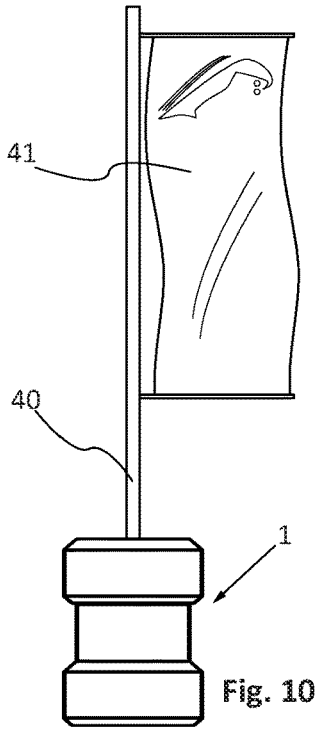

FIG. 10 illustrates yet another example of use of the concrete block 1 equipped with the pole 40 of FIG. 5B so as to support a banner 41.

Figure 11:
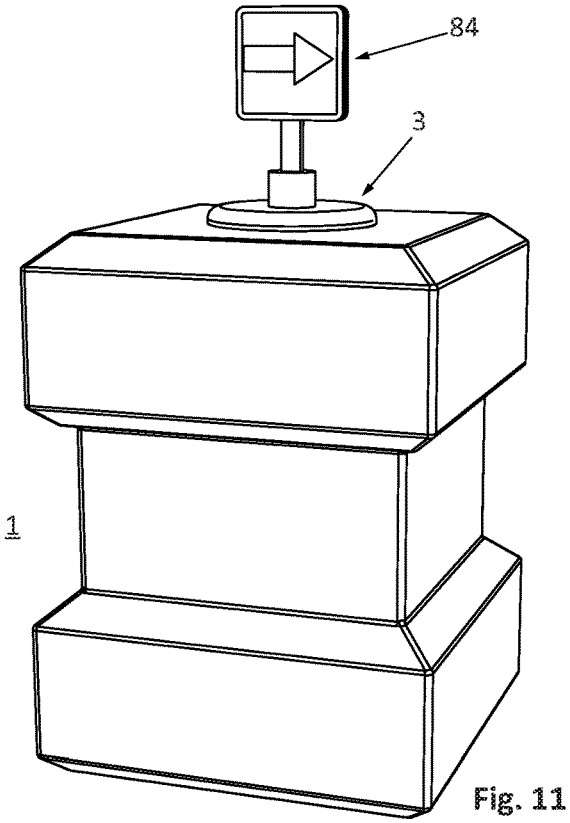

FIG. 11 shows the concrete block 1 used as a support for a sign apparatus 84, for example to be set up temporarily during work, to support a sign panel or a work light. The sign apparatus 84 is attached by way of the attachment means 3 that are of the attachment plate type.

Figure 12:
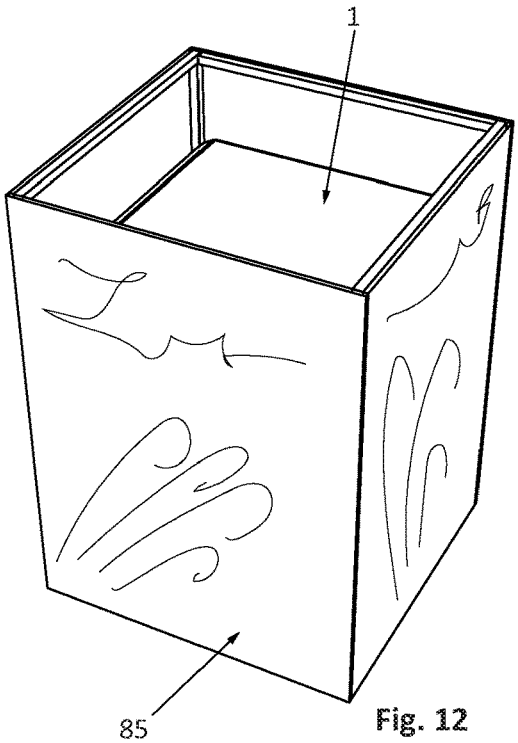

FIG. 12 shows the concrete block 1 used as a support for an advertising apparatus 85, said apparatus consisting of a hollow cylindrical panel of a height corresponding to that of the block, and whose peripheral geometry corresponds to that of the peripheral contour of the block, here a multifaceted polygonal panel to correspond to the number of faces of the block.

Figure 13A:
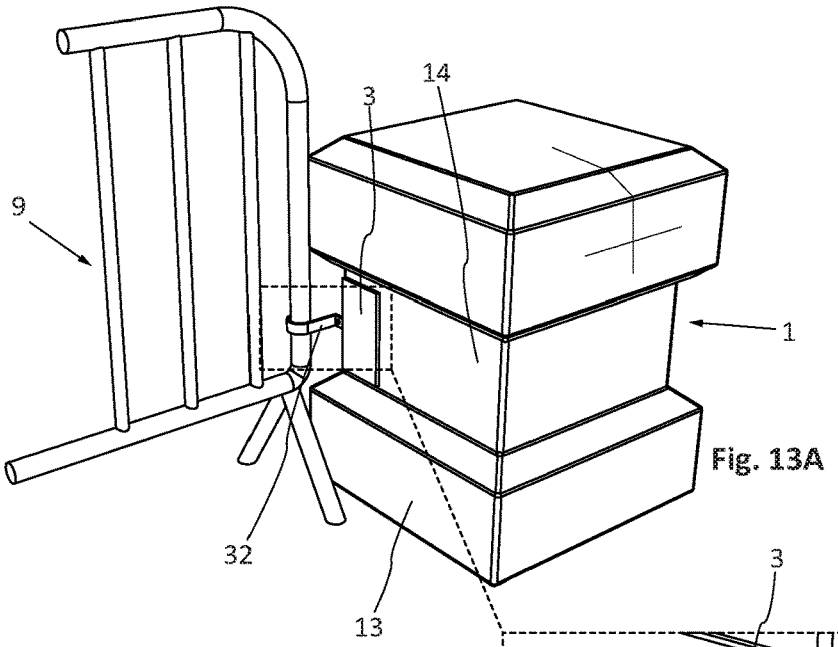
FIG. 13A illustrates a perspective view of a block of the invention used to support a barrier.

FIG. 13A shows the use of the block 1 as a support for removable attachment of a barrier 9, for example of a Vauban-type barrier with bars. In this configuration, the block 1 has the attachment means 3 that are placed on the lateral wall 13, preferably in the peripheral throat 14. The attachment means 3 here appear in the form of a square plate made integral (for example by bolting, not shown here) with a corner of the block.

In this embodiment, the attachment means 3 are configured to not protrude beyond the lateral face 13 when not in use, so that when the block is not in use, there is no danger of being accidentally hooked with the attachment means, and the blocks can be abutted to one another without difficulty for their storage, for example, during their transport.

Figure 13B:
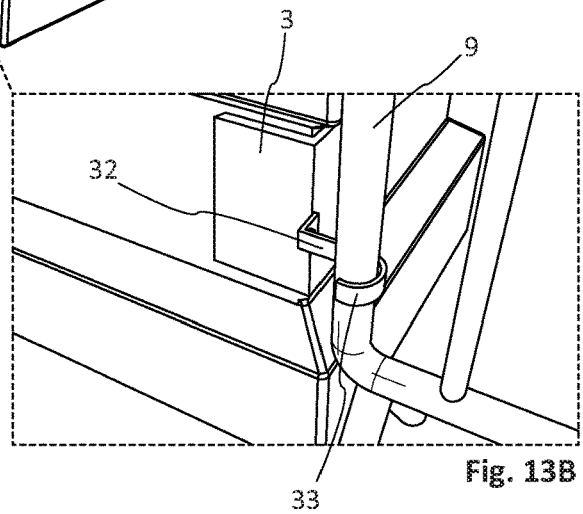
FIG. 13B is a detail view of FIG. 13A.

The attachment means 3 have an attachment element 32 that is able to work mutually with the barrier 9, as is seen in the detail view of FIG. 13B, particularly by comprising an arm attached to the plate 3 and a hook 33 that works by hooking with the end bar of the barrier 9. The attachment element 32 that ensures the connection between the block 1 and the barrier is designed to withstand the toppling of several barriers abutted by hooking.

Figure 13C:
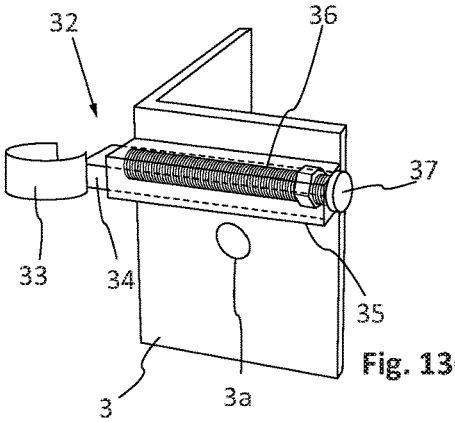
FIG. 13C is an example embodiment according to the invention of attachment means to engage an apparatus with the block.

FIG. 13C illustrates an attachment plate 3 provided with at least one attachment hole 3*a* to secure the plate to the block 1 by bolting, and with an attachment element 32 according to a preferred embodiment of the invention. The attachment element 32 is telescopic by being adjustable in length in a horizontal plane when the plate is attached to the block so as to make possible an adjustment of the separation distance of the block 1 from the technical apparatus to be engaged, such as the barrier 9. The attachment element 32 has a hook 33 that is integral with a slide 34 that is able to be mobile in a tube 35 by means of an adjusting screw 36 that works with the slide 34 and whose adjusting head 37 projects out of the tube 35 opposite the hook 33.

Figure 14:
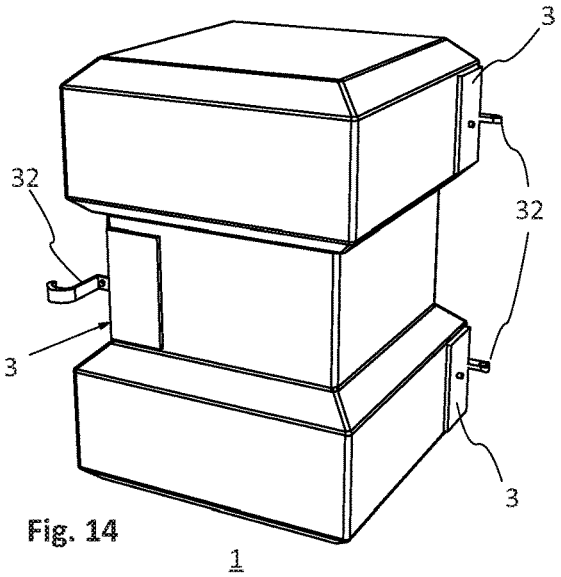
FIG. 14 is a perspective view of the block of the invention showing different means of attachment.

FIG. 14 shows an additional example embodiment of the block relative to the positioning of the attachment means 3. In no way limiting, the block 1 is provided with attachment plates 3 arranged in two opposite corners of the block, respectively in the throat 14 and in the low and high parts of the block, symmetrically to the peripheral throat 14. Further, the low and high attachment plates 3 have an attachment element 32 of a shape different than hook-shaped, here in the shape of a ring.

In the context of the use of a barrier, another example for attachment or for engagement of technical apparatus is the one making possible a sliding engagement of the barrier relative to the concrete block (not shown in the figures). Thus, the body of the block comprises attachment/engagement means that constitute guide means for the sliding barrier. These engagement means make it possible to have the barrier slide parallel to the block. The block and the sliding barrier can, for example, ensure the closing/opening of an access of a public road in particular to screen this access, one of the ends of the barrier being engaged with one of the sides/edges of the block in the closed position of the barrier while the other end of the barrier works with a stop positioned on another block of the invention that is spaced apart by the length of the barrier, or any other stop. The engagement means attached to the body of the block are, for example, two pairs of guide rollers, such as ordinary guide rollers for a gate, the pairs of rollers being attached to one of the vertical faces of the body of the block, and preferably placed respectively in the low part and in the high part of the block; the barrier is equipped with wheels and is able to slide between the two guide rollers of each pair of rollers.

The concrete block of the invention will present its attachment means 3 with an apparatus to be added, which will be arranged as a function of the type of apparatus and of the use.

Figure 15:
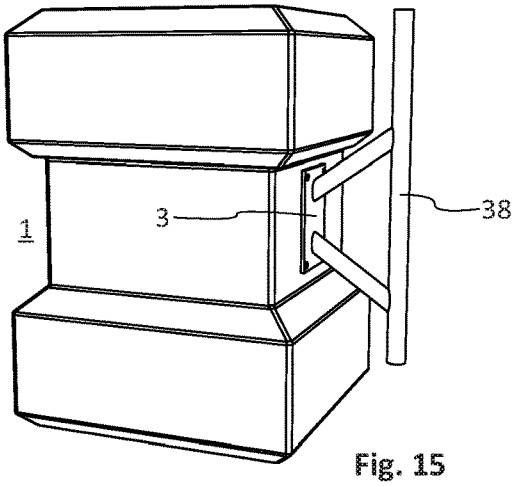
FIG. 15 is an additional example of attachment means.

FIG. 15 illustrates the block 1 of the invention equipped with a hooking bar 38 as an attachment element that is integral with an attachment plate 3. The bar 38 is metal, for example made of galvanized steel. It extends parallel to a lateral face of the block and projecting from it. It is attached by means of the attachment means 3, such as a plate made integral with the lateral face of the block, more particularly in the area of the throat 14, by means of the attachment means that are anchored in the block. The bar 38 can have various functionalities, such as to make possible the attachment of a barrier, of a banner . . . .

Figure 16A:
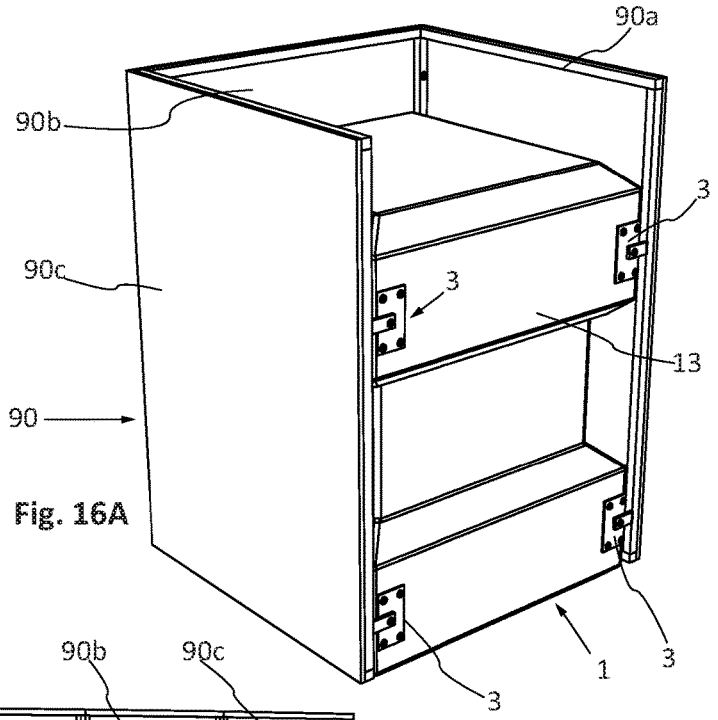
FIG. 16A shows a block equipped with a fence in a folded and stored state.
Figure 16B:
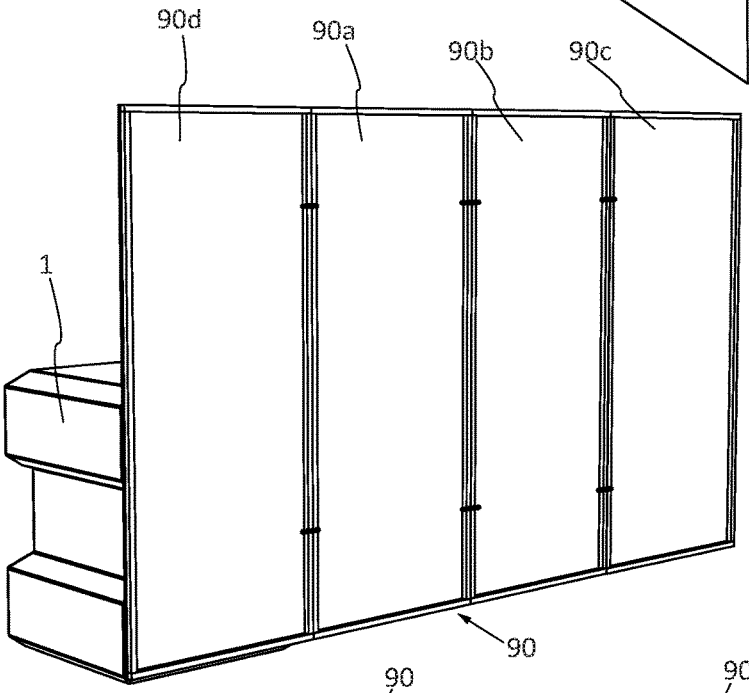
FIG. 16B corresponds to FIG. 16A with the fence unfolded.

FIGS. 16A and 16B illustrate yet another use for the concrete block of the invention. The concrete block 1 constitutes the support for attachment of a fence 90, and advantageously for storing the fence when not in use. The fence 90 is foldable/unfoldable and has at least three vertical panels 90*a*, 90*b*, and 90*c*, preferably metal, such as of galvanized steel, which are hinged to one another to have, in the folded state of the fence (FIG. 16A), a U shape surrounding at least three of the vertical faces of the lateral wall 13 of the block, and in the unfolded state (FIG. 16B), an extension that is linear and (approximately) coplanar to one of the vertical faces of the block.

With regard to FIG. 16A, the width of each panel 90*a* to 90*c* corresponds to the width of each of the lateral faces of the block with which a panel is engaged in the folded position of the fence. The end panels 90*a* and 90*c* of the fence are attached by the attachment means 3, such as attachment plates that are integral at least with one of the vertical faces of the lateral wall 13, a face opposite to the one engaged with the middle panel, and near the four low and high corners of said face. A fourth panel 90*d*, visible in FIG. 16B, can be provided in addition by being mounted in a detachable manner on the vertical face of the block that is provided with the attachment means 3, so as in particular to hide the concrete block. The attachment of the panels to the attachment means 3 can, for example, be done by means of hooks that are integral with the panels with rings that are integral with the attachment means 3.

Figure 16C:
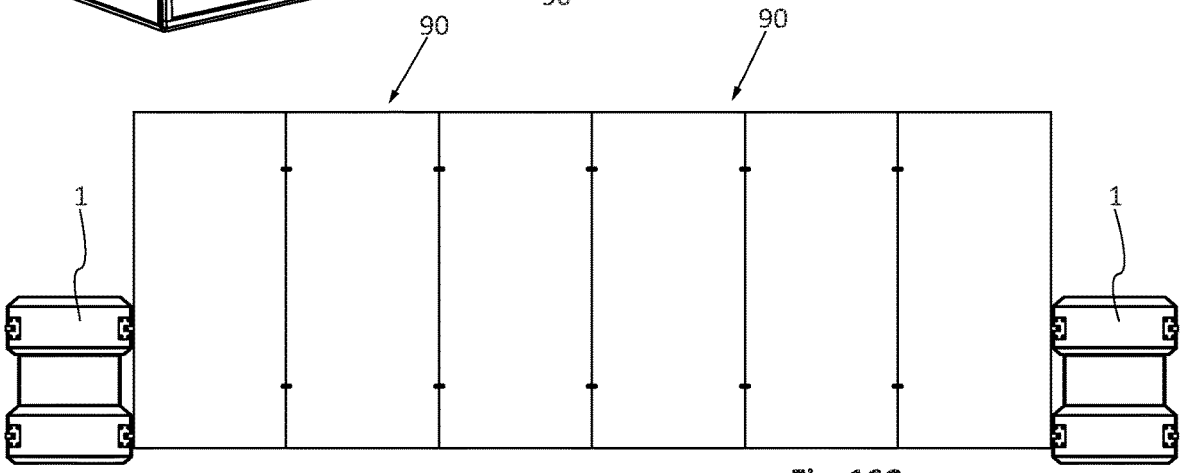
FIG. 16C is a diagrammatic front view of two blocks of the invention combined with a continuous fence between the two blocks.

FIG. 16C illustrates the pairing of two foldable fences 90 by positioning two concrete blocks 1 of the invention that are spaced apart and each equipped with a fence 90 in the unfolded state providing a continuous metal wall.

The height of the concrete block 1 will be adapted to the height of the fence 90 to provide an attachment that is high enough for the end panel and for the start of the fence, so as to ensure sufficient rigidity in height for the fence in its expanded/unfolded state.

Figure 17:
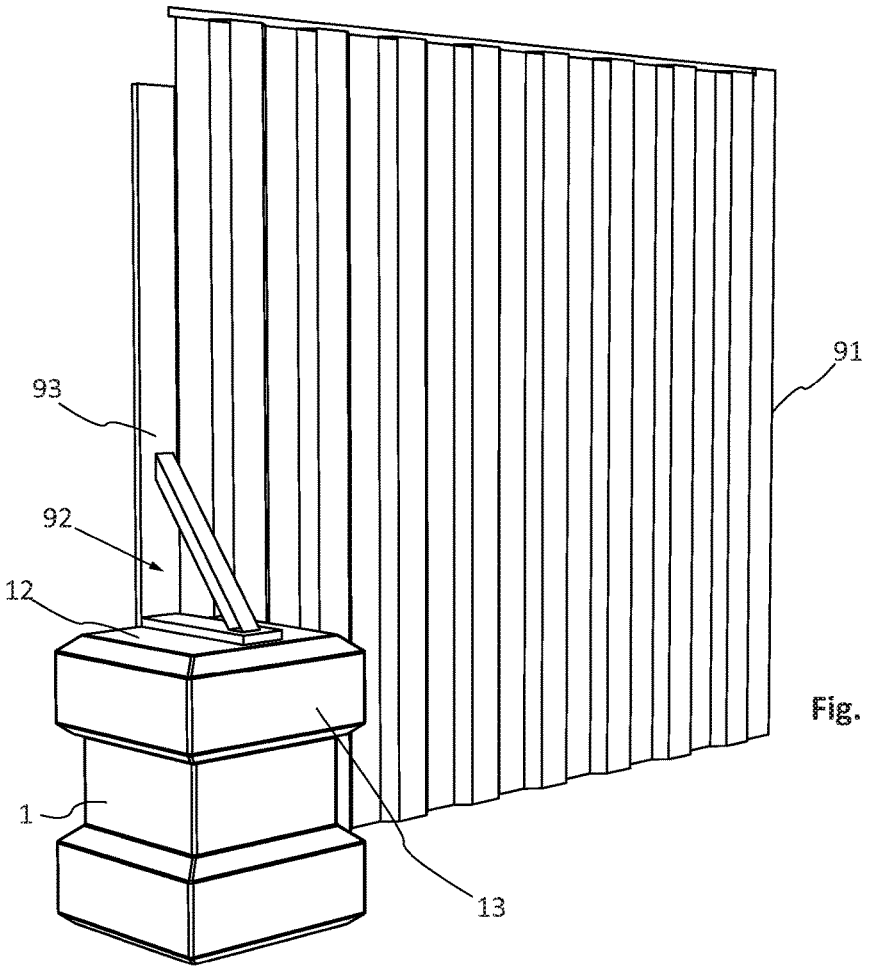
FIG. 17 is a rear perspective view of a block of the invention equipped with fencing.

FIG. 17 also shows an additional variant of the block 1 for supporting a fence or fencing 91. The block 1 has at least one brace 92 that is attached to the upper face 12 of the block.

The securing of the brace is preferably done as a result of the attachment means 3 provided on the upper face of the block during its manufacture.

The brace 92 has an upright 93 extending vertically near one of the peripheral edges of the upper face 12 and in a manner that is approximately coplanar to one of the vertical faces of the peripheral wall 13, so as to make possible the releasable attachment of the fencing 91 in the extension of said vertical face. Advantageously, depending on the type of fencing to be set up, the brace 92, more particularly the upright 93, will be provided with means for attaching and for working that are suitable with the type of fencing. By way of example, the upright 93 has suitable means for attachment to construction site fencing of the type of that marketed by the Heras® Company.

Figure 18B:
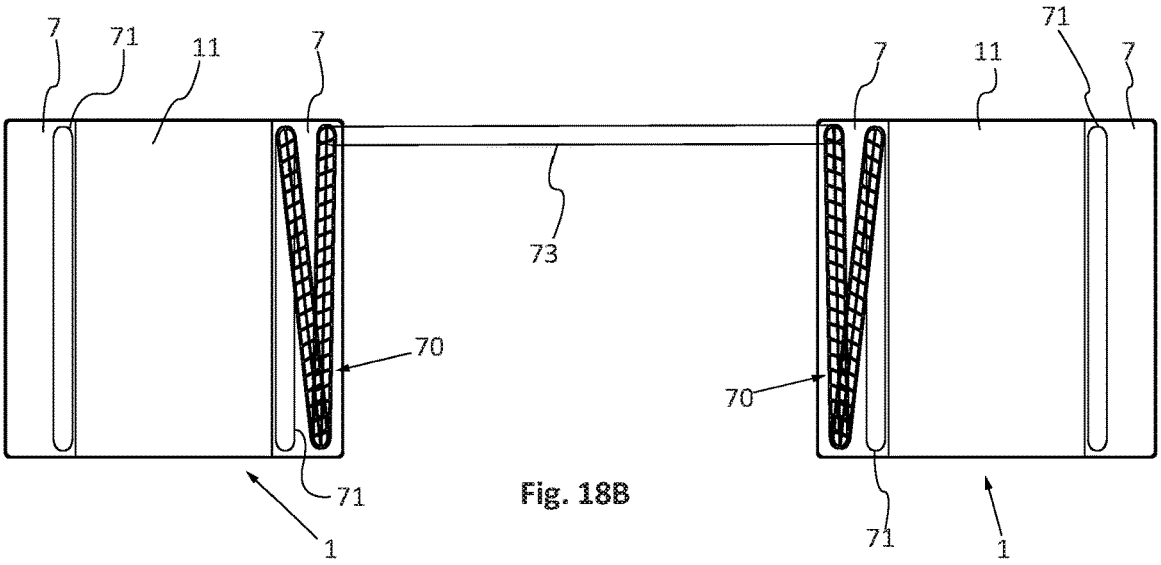
FIG. 18B is a diagrammatic top view of the underside of two blocks of FIG. 18A that are spaced apart and connected to one another by two traffic barriers, each of the traffic barriers being folded underneath a space of each block.
Figure 18C:
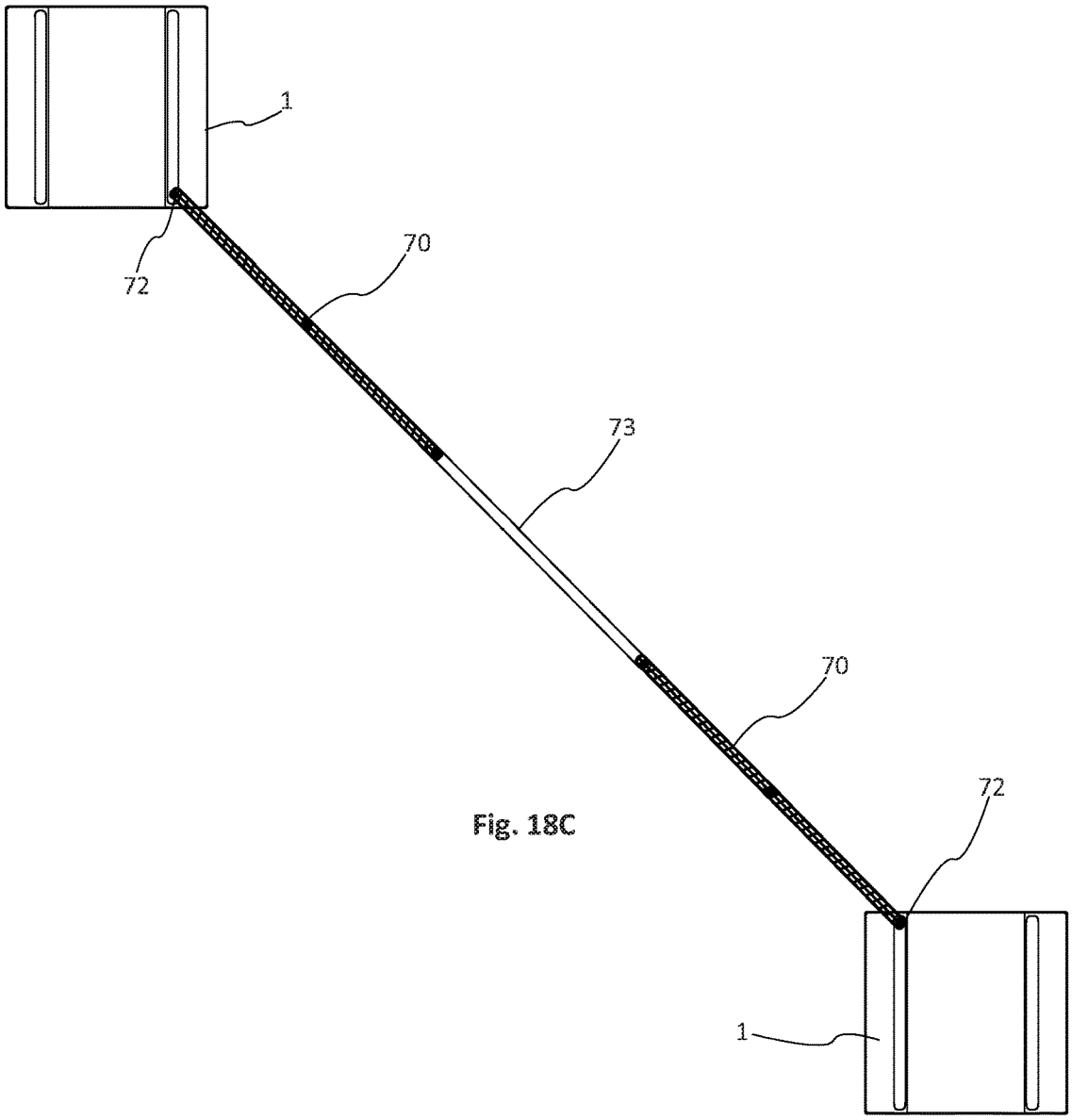
FIG. 18C represents a diagrammatic view of FIG. 18B in the unfolded position of the traffic barriers, the blocks having been moved.

Finally, FIGS. 18A to 18C also illustrate an additional example of embodiment and use of the concrete block 1 of the invention in an access-denial device comprising two concrete blocks 1 of the invention and traffic barriers.

The concrete block 1 is configured to receive in the low part (FIG. 18A) a folding roadblock traffic barrier 70 with spikes. For this purpose, the body 10 of the block 1 has a lower space 7, at least on one of its sides, along an L-shaped recess on its lower face 11 and from the peripheral lateral wall 13. The recess is made over a height that is greater than the height of the spikes of the traffic barrier.

The recess 7 further has a runner 71 with a longitudinal axis extending parallel to the edge of the lateral wall, with a length that is less than the recess 7 (for example, 700 mm for a recess length of 950 mm), and opening out opposite the lower face 11. This runner is intended to receive a pin 72 perpendicular to said runner 71 and integral with the traffic barrier 70, in such a way as to engage the traffic barrier with the body of the block 1. The pin 72 of the traffic barrier also constitutes a pivoting axis for the traffic barrier, in a horizonal plane, making it possible for the traffic barrier 70 to be unfolded and, if necessary, to slide in the runner 71.

In the position of use (FIGS. 18B and 18C), the access-denial device has two concrete blocks 1 that are spaced apart and each equipped with a fold-out traffic barrier 70, the two traffic barriers being, on the one hand, in their folded state (FIG. 18B) and each stored in the recess 7 of the associated block, and, on the other hand, connected to one another by a rigid rail 73, the rail corresponding to the length of separation of the two blocks 1, in particular 1,400 mm.

In the event of a determination to intrude, if a truck strikes one of the blocks 1, the latter, while moving, will cause the deployment of the two traffic barriers (FIG. 18C) with a separation of the two blocks 1 to a length of 4,200 mm, necessarily causing the truck to be shoved aside or to drive over the traffic barrier, regardless of the position of the wheel assemblies, inevitably stopping it.

Consequently, the concrete block 1 proposed by the invention constitutes—upon exiting from manufacture, in addition to an access-denial system—a functional block with which various technical apparatus can be engaged as a result of its spaces and/or attachment means that are incorporated into the body of the block, and in such a way as to be delivered ready to be set up and ready for use.

The invention claimed is:

1. A concrete block comprising:

a body comprising at least two opposite faces including a lower face and an upper face opposite the lower face when the block is in a set-up position on the ground, a peripheral lateral wall connecting the two opposite faces, an outer surface of the peripheral lateral wall having a space forming a recess of the outer surface to make a throat configured as an attachment surface, and one or more of a plurality of spaces and an attachment/engagement system configured to attach or engage at least one technical apparatus to be engaged with the block; and an anchoring system configured to lift the block, the anchoring system being integral with the body and mounted in blind cavities without protruding out of the blind cavities, the anchoring system being mounted in one of the faces of the body of the block.

2. The concrete block according to claim 1, wherein the anchoring system is configured to work with a lifting engagement system, the anchoring system being configured to work mutually only with a single type of lifting engagement system that is specifically dedicated to a type of the anchoring system, so that the anchoring system is not configured to work with a universal lifting system or a common hook lifting system.

3. The concrete block according to claim 1, wherein the body of the block has edges that are beveled.

4. The concrete block according to claim 1, wherein the outer surface of the peripheral lateral wall comprises at least one attachment plate as the attachment/engagement system, said attachment plate being equipped with one or more attachment/engagement elements that are configured to work with the at least one technical apparatus to be engaged with the block, to engage at least one barrier, the attachment/engagement elements being one of: (i) a bar, an element configured to work by mutual engagement with the at least one technical apparatus to be engaged, and (iii) at least one pair of guide rollers between which a barrier is configured to slide.

5. The concrete block according to claim 4, wherein the at least one barrier is a Vauban barrier.

6. The concrete block according to claim 1, wherein the body constitutes a base for attachment of the at least one technical apparatus on one or more of the upper face and the peripheral lateral wall.

7. The concrete block according to claim 1, wherein the body comprises one or more of:

(i) on the face equipped with the anchoring system, as one of the spaces, a central opening that is configured to receive a pole or a post, (ii) an attachment interface plate as the attachment/engagement system, and (iii) attachment elements that are threaded-rods, the at least one attachment interface plate or the attachment elements being configured to attach at least one support leg or the post equipped with a system configured to adjust height of the at least one technical apparatus working with the post.

8. The concrete block according to claim 1, further comprising a base for attachment of one of: (i) an electric power distribution cabinet on the upper face of the body and (ii) at least one support leg to a support leg of the at least one technical apparatus.

9. The concrete block according to claim 1, further comprising hinged and foldable panels, at least one of the hinged and foldable panels being attached to the peripheral lateral wall.

10. The concrete block according to claim 1, wherein the one or more spaces comprise at least one space configured to store a collapsible traffic barrier in a collapsed state.

11. The concrete block according to claim 1, further comprising at least one space in which a traffic barrier is configured to be attached.

12. The concrete block according to claim 1, further comprising:

a first space that passes through the entirety of the body of the block, along the entire height of the block, the first space being configured to house a bar with a length that is less than that of the first space, and a second space constituting an access passage to the first space, the bar being configured to work with a connecting element configured to be inserted into the first space by the second space.

13. An access-denial block comprising at least one concrete block of claim 1, the access-denial block having a base or a support for attachment or engagement of the at least one technical apparatus.

14. The concrete block according to claim 13, wherein the at least one technical apparatus is one of a pole, a post, a gateway, a support leg, an electric power distribution cabinet, a signpost, a hooking bar, a barrier, fencing, a fence, and an access-denial traffic barrier.

15. The concrete block according to claim 1, wherein the body of the block has a general parallelepiped shape, and at least vertical edges of the body that are vertical in the set-up position of the block, edges of the upper face, and edges of any surface recess are beveled.

16. The concrete block according to claim 1, wherein the space forming the recess to make the throat is over an entire periphery and in a middle part of the peripheral lateral wall.

17. The concrete block according to claim 1, wherein the body constitutes a base for attachment on one or more of the upper face and the peripheral lateral wall of the at least one technical apparatus, the lower face being flat continuously from or near one edge thereof up to or near an opposite edge thereof.

18. The concrete block according to claim 1, further comprising at least one illuminating system that is a reflector, the at least one illuminating system being positioned in a lower part of the block in the set-up position of the block, the at least one illuminating system being configured to illuminate upward.

19. The concrete block according to claim 18, wherein the illuminating system is configured to illuminate with an illumination angle that corresponds to two upper corners of the block to identify the volume of the block at night.

20. The concrete block according to claim 1, wherein the concrete block is made of reinforced-fiber concrete.

* * * * *